US010381735B2

(12) United States Patent
Miraftab et al.

(10) Patent No.: US 10,381,735 B2
(45) Date of Patent: Aug. 13, 2019

(54) MULTI-BAND SINGLE FEED DIELECTRIC RESONATOR ANTENNA (DRA) ARRAY

(71) Applicant: Huawei Technologies Co., Ltd., Shenzhen (CN)

(72) Inventors: Vahid Miraftab, Ottawa (CA); Fayez Hyjazie, Ottawa (CA); Halim Boutayeb, Kanata (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 124 days.

(21) Appl. No.: 15/075,983

(22) Filed: Mar. 21, 2016

(65) Prior Publication Data

US 2017/0271772 A1 Sep. 21, 2017

(51) Int. Cl.

| | |
|---|---|
| ***H01Q 13/10*** | (2006.01) |
| ***H01Q 9/04*** | (2006.01) |
| ***H01Q 21/00*** | (2006.01) |
| ***H01Q 21/06*** | (2006.01) |

(52) U.S. Cl.
CPC ..... *H01Q 9/0485* (2013.01); *H01Q 21/0075* (2013.01); *H01Q 21/061* (2013.01)

(58) Field of Classification Search
CPC .... H01Q 5/50; H01Q 21/0075; H01Q 9/0484; H01Q 21/061
See application file for complete search history.

(56) References Cited

U.S. PATENT DOCUMENTS

| | | | | |
|---|---|---|---|---|
| 5,952,972 | A * | 9/1999 | Ittipiboon | H01Q 9/0485 343/700 MS |
| 6,081,239 | A * | 6/2000 | Sabet | H01Q 1/40 343/700 MS |
| 6,469,682 | B1 | 10/2002 | de Maagt et al. | |
| 2009/0128434 | A1* | 5/2009 | Chang | H01Q 9/0492 343/767 |
| 2011/0248890 | A1* | 10/2011 | Lee | H01Q 1/2283 343/700 MS |
| 2016/0156373 | A1 | 6/2016 | Zhai et al. | |
| 2016/0204509 | A1 | 7/2016 | Zhai et al. | |
| 2016/0218438 | A1 | 7/2016 | Miraftab et al. | |

FOREIGN PATENT DOCUMENTS

| | | |
|---|---|---|
| CN | 102130376 | 7/2011 |
| CN | 102694268 | 9/2012 |

(Continued)

OTHER PUBLICATIONS

A. Petosa et al, Perforated Dielectric Resonator Antennas, Electronics Letters Nov. 21, 2002 vol. 38 No. 24, pp. 1493-1494.*

(Continued)

*Primary Examiner* — Dieu Hien T Duong

(57) ABSTRACT

A multi-band single feed dielectric resonator antenna (DRA) and DRA array are provided. The DRA is made of a dielectric material having a first and second antenna regions wherein the second antenna region has a different dielectric constant than the first antenna region. The dielectric material is supported by a feeding substrate. The feeding substrate has a top surface ground plane having a slot positioned below the first antenna region of the dielectric material and a microstrip feeding line on the bottom surface in alignment with the slot on the top surface ground plane.

21 Claims, 10 Drawing Sheets

(56) References Cited

FOREIGN PATENT DOCUMENTS

| | | |
|---|---|---|
| CN | 102904049 | 1/2013 |
| WO | 03007425 | 1/2003 |

OTHER PUBLICATIONS

Aldo Petosa et al, Array of Perforated Dielectric resonator Antennas, IEEE 2004, pp. 1106-1109.*
M. Wei et al.; "Design of an X/Ka Dual-Band Co-Aperture Broadband Microstrip Antenna Array"; Microwave Technology and Computational Electromagnetics (ICMTCE), pp. 217-220, May 22 to 25, 2011.
K. Naishadham et al.; "A Shared-Aperture Dual-Band Planar Array With Self-Similar Printed Folded Dipoles"; IEEE Transactions on Antennas and Propagation, vol. 61, No. 2, Feb. 2013.
Wael M. Abdel-Wahab et al.; "Low Cost Planar Waveguide Technology Based Dielectric Resonator Antenna (DRA) for Millimeter-Wave Applications: Analysis, Design, and Fabrication"; IEEE Transaction on Antennas and Propagations; 58, Issue 8, pp. 2499-2507.
Guan-Yu Chen et al.; "The Novel 3-Way Power Dividers/Combiners Structure and Design"; WAMICON 2006.
Buerkle et al.; "Compact Slot and Dielectric Resonator Antenna with Dual-Resonance, Broadband Characteristics"; IEEE Transaction on Antennas and Propagation, vol. 53, No. 3, pp. 1020-1027.
International Search Report and Written Opinion for International Patent Application No. PCT/CN2016/079208 dated Jul. 22, 2016.
Partial Translation of cited Chinese application 102130376A.
Partial Translation of cited Chinese application 102694268.
Translation of Abstract for cited Chinese application No. 102904049.
Zheng, Hong-Xing et al.; "Analysis of dielectric resonator antenna array by using unconditionally stable pseudospectral time-domain method"; IEEE Antennas and Wireless Propagation Letters, vol. 8, 2009.

* cited by examiner

MULTI-BAND SINGLE FEED DIELECTRIC RESONATOR ANTENNA (DRA) ARRAY

TECHNICAL FIELD

The present disclosure relates to multi-band antenna arrays and in particular to multi-band single feed dielectric resonator antennas and antenna arrays.

BACKGROUND

A dielectric resonator antenna (DRA) is formed from a dielectric resonator mounted on a metal surface providing a ground plane which is fed a signal for transmission. DRA antennas are used at microwave and higher frequencies, such as millimeter wave, E-Band and fifth generation (5G) spectrum bands due to their size, bandwidth and radiation efficiency. The resonance frequency is determined by the dimensions and dielectric constant $\varepsilon_r$ of the dielectric material which can be determined based upon the composition and structure of the material used.

Multi-band antenna arrays offer increased transmission capacity with small size antennas and steerable multi-band arrays are very beneficial for phased array systems at desired frequency bands. However multi-band interleaved antennas need either isolated or dual-mode feed networks. The use of dual-mode feeds results in additional complexity, size and cost of the array. Interleaved antennas with a dual mode feed offer lower cost but often suffer from strong coupling between bands which can impact performance.

SUMMARY

In accordance with an aspect of the present disclosure there is provided a multi-band single feed dielectric resonator antenna (DRA). The DRA comprises a monolithic dielectric material comprising a first antenna region of the dielectric material having a first dielectric constant; and a second antenna region of the dielectric material having a second dielectric constant, the second antenna region surrounding the first antenna region. The DRA also comprises a feeding substrate supporting the dielectric material, the feeding substrate comprising: a top surface ground plane having a slot within the ground plane positioned below the first antenna region of the dielectric material; and a microstrip feeding line on the bottom surface in alignment with the slot on the top surface ground plane.

In accordance with an aspect of the present disclosure there is provided a dielectric resonator antenna (DRA) array. The DRA array comprises a monolithic dielectric material comprising a plurality of first antenna regions each having a first dielectric constant and a second antenna region of the dielectric material having a second dielectric constant, the second antenna region surrounding the plurality of first antenna regions and a feeding substrate supporting the dielectric material. The feeding substrate comprises a top surface ground plane having a plurality slots, each slot positioned below a respective one of the plurality of the first antenna regions of the dielectric material and a plurality of microstrip feeding lines on the bottom surface in alignment with the slots, each of the plurality of microstrip feeding lines aligning with the plurality of first antenna regions for connection to a microstrip feed network.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

There is a need for an improved multi-band single feed dielectric resonator antenna (DRA).

Embodiments are described below, by way of example only, with reference to FIGS. 1-10.

A multi-band single feed artificial DRA is disclosed. The DRA provides a simplified and efficient design without need for additional feeding layers and diplexer with reduced coupling effects. The DRA is formed from a single monolithic dielectric material providing two regions each having different dielectric constants and therefore a different frequency response. The dielectric constant is determined through physical properties of the dielectric which can be dictated by the doping and composition of the dielectric. Alternatively a different dielectric constant can be achieved by modifying a portion of the dielectric by the introduction of voids, air holes, perforations, or indentation(s) in one region of the antenna dielectric. The physical modification of the dielectric to create a second region in the dielectric material provides an artificial or homogenous material with two regions having different dielectric constants which can be easily manufactured. The dielectric material is supported on a feeding substrate such as a printed-circuit board (PCB) having a top surface ground plane with a slot positioned below a first antenna region of the dielectric material. A microstrip feeding line on the bottom surface of the feeding substrate is in alignment with the radiating slot on the top surface ground plane. The microstrip feeding line provides a single feed line enable multi-band operation.

By modifying the dielectric by the introduction of voids, air holes, perforations or indentation(s) to change the dielectric constant, the manufacturability of the antenna improved as only one type of dielectric is required. The DRA array can be used in different frequency bands of interest with the benefit of only requiring a single feed line. In addition, the single feed removes the need for diplexer in sub-array level and provides compatibility with different sub-array schemes. The multi-band array provides increased signal capacity and provides ease of manufacturing using low-cost PCB technology and is millimeter-wave/E-band (70/80 GHz), and can provide 5G wireless compatibility.

Figure 1:
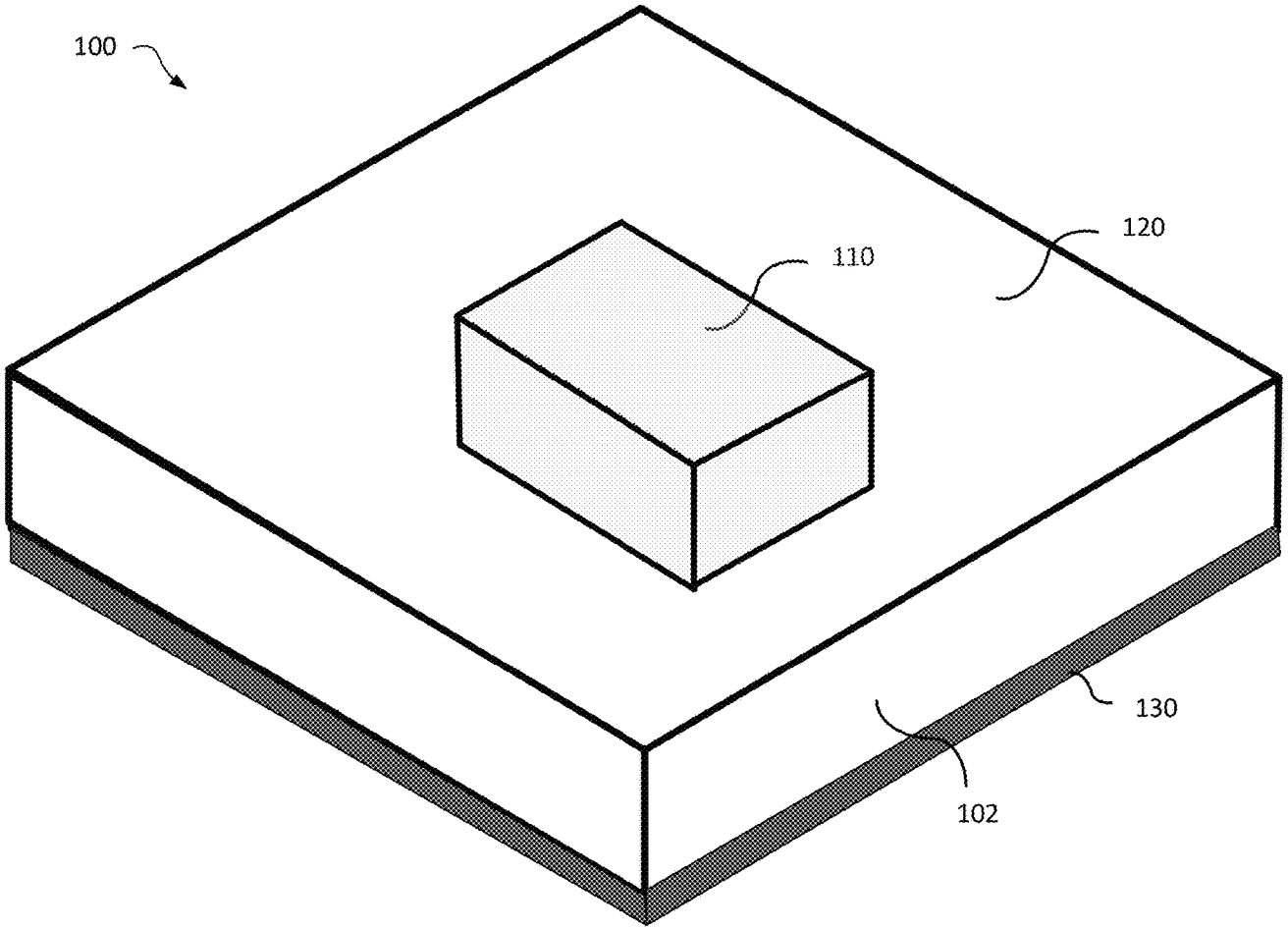
FIG. 1 shows a perspective view of a dielectric resonator antenna (DRA) in accordance with an embodiment of the present disclosure.

FIG. 1 shows a perspective view of a dielectric resonator antenna (DRA) 100. The DRA 100 comprises a rectangular dielectric material 102 having at least two regions each with different dielectric constants formed from the same material. Although a rectangular dielectric is shown, other shapes such as, but not limited to for example cylindrical, half sphere, trapezoidal may be utilized. The dielectric constant of the dielectric material 102 is modified or altered within the second antenna region 120 providing an artificial or homogeneous material which surrounds the first antenna region 110 having a higher dielectric constant. As opposed to using two different dielectric materials, the first antenna region and second antenna region are contiguous within a homogenous monolithic dielectric material 102. The dielectric material 102 is supported by a feeding substrate 130. The first antenna region has a higher dielectric constant, such as. for example, $\varepsilon_r$ 10.2 where the second antenna region can have dielectric constant of, for example, $\varepsilon_r$ of 4.5. The first antenna region radiates efficiently at a frequency higher than the second antenna region having a lower dielectric constant enabling multi-band operation of the DRA. In an embodiment, the dielectric material may be approximately 1.3 mm in thickness and the first antenna region can be approximately 1.8 mm in width by approximately 2.2 mm in length. The dimensions may vary on the desired frequency of the DRA, the dielectric material utilized and the method by which the dielectric material is modified in the second region.

Figure 2:
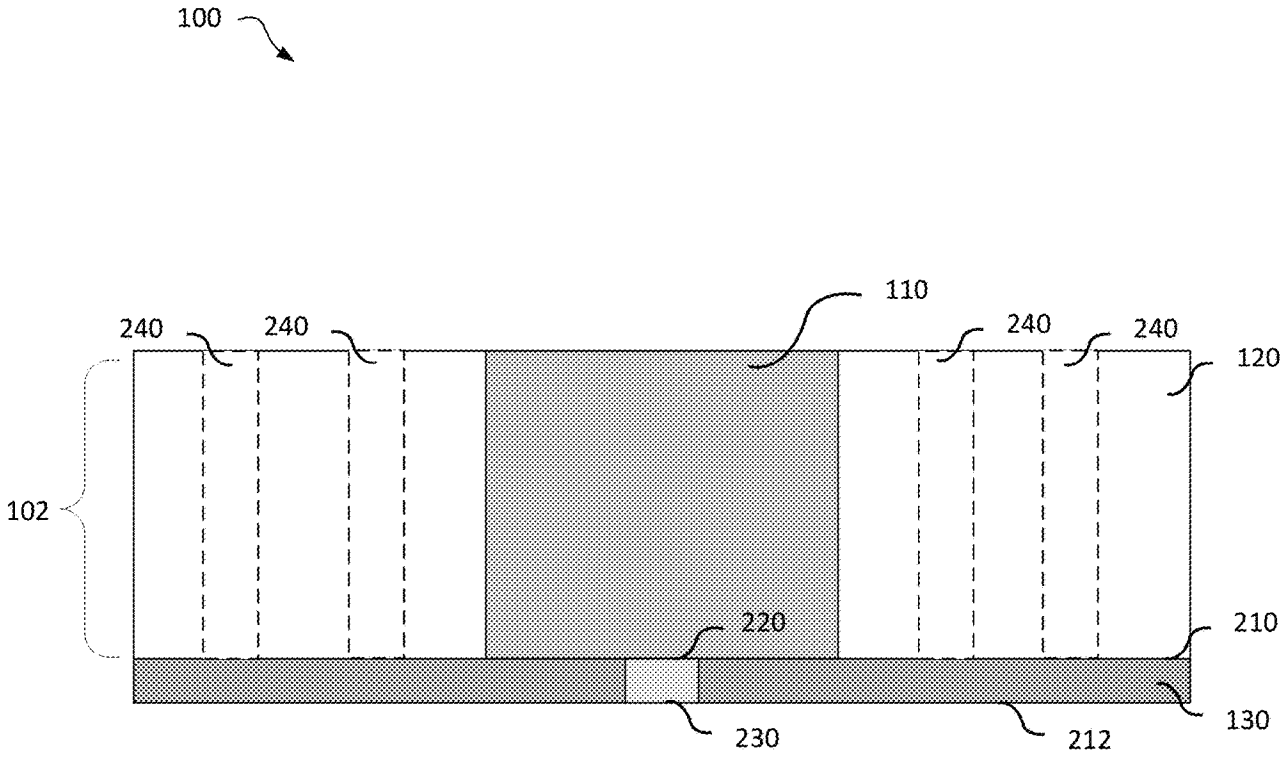
FIG. 2 shows a side view of the DRA.

Referring to FIG. 2, the first antenna region 110 and second antenna region 120 of the DRA 100 are defined by a dielectric constant. For the second antenna region 120, this constant is modified by physical changes in the permittivity of the dielectric, caused by, for example the introduction of air holes 240, perforations, or indentations into the dielectric material. The dielectric 102 is placed on top of a feeding substrate 130 where the top surface 210 of the feeding substrate 130 provides a ground plane having a rectangular slot 220 underneath the first antenna region 110. The bottom surface 212 of the feeding substrate 130 has a microstrip feeding line 230 beneath the slot 220. The microstrip feeding line 230 is coupled to a microstrip feed line or feed line network. Although air holes or perforations are described the dielectric constant of the dielectric material may alternatively be modified by the use of voids, dimples, hollows or indentations to change the dielectric material to achieve a lower dielectric constant for the associated region. Only the first antenna region 110 is used for the radiation and can resonate at different modes. The second antenna region modifies the resonating modes (frequencies) of the first antenna to enable multi-band operation of the DRA.

Figure 3:
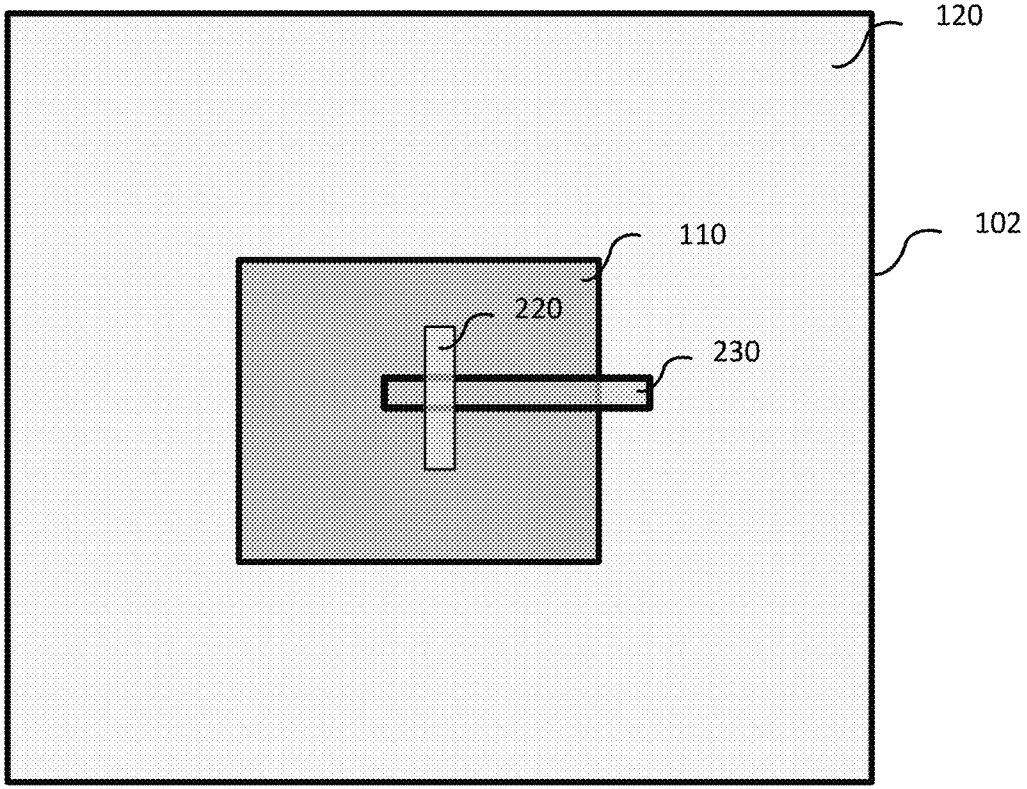
FIG. 3 shows top view of the DRA.
Figure 4:
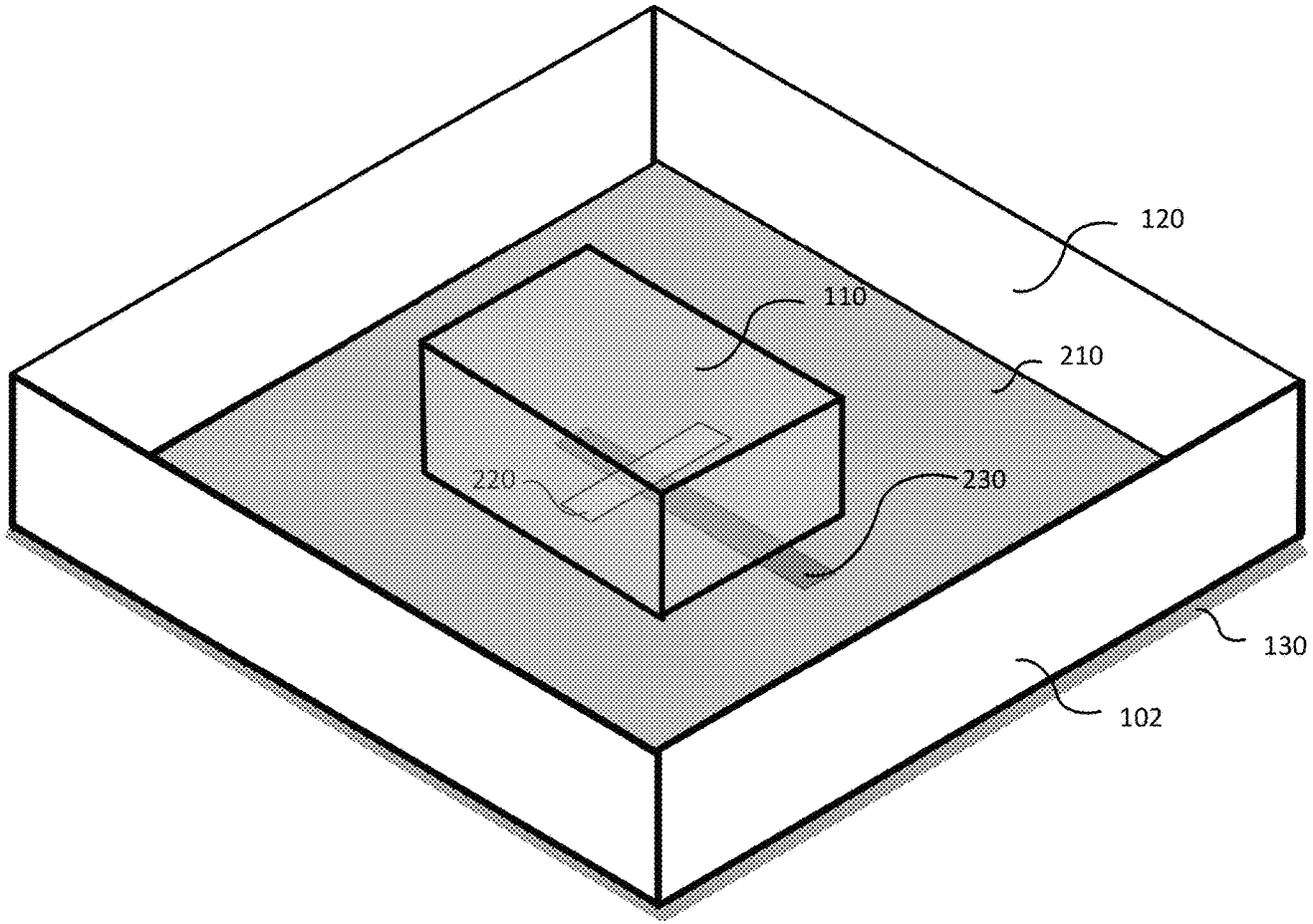
FIG. 4 shows a perspective view of the DRA showing the printed circuit board substrate.

With reference to FIG. 3 and FIG. 4, the slot 220 is positioned within the first antenna region 110 defining a rectangular slot which is perpendicular to the microstrip feeding line 230. The microstrip feeding line 230 can extend beyond the first antenna region 110 into the second antenna region 120. Although a rectangular slot is described, alternative slot shapes such as, but not limited to, circular, square, trapezoidal, or triangular may be used dependent on the frequency, dielectric material or antenna pattern desired.

Figure 5:
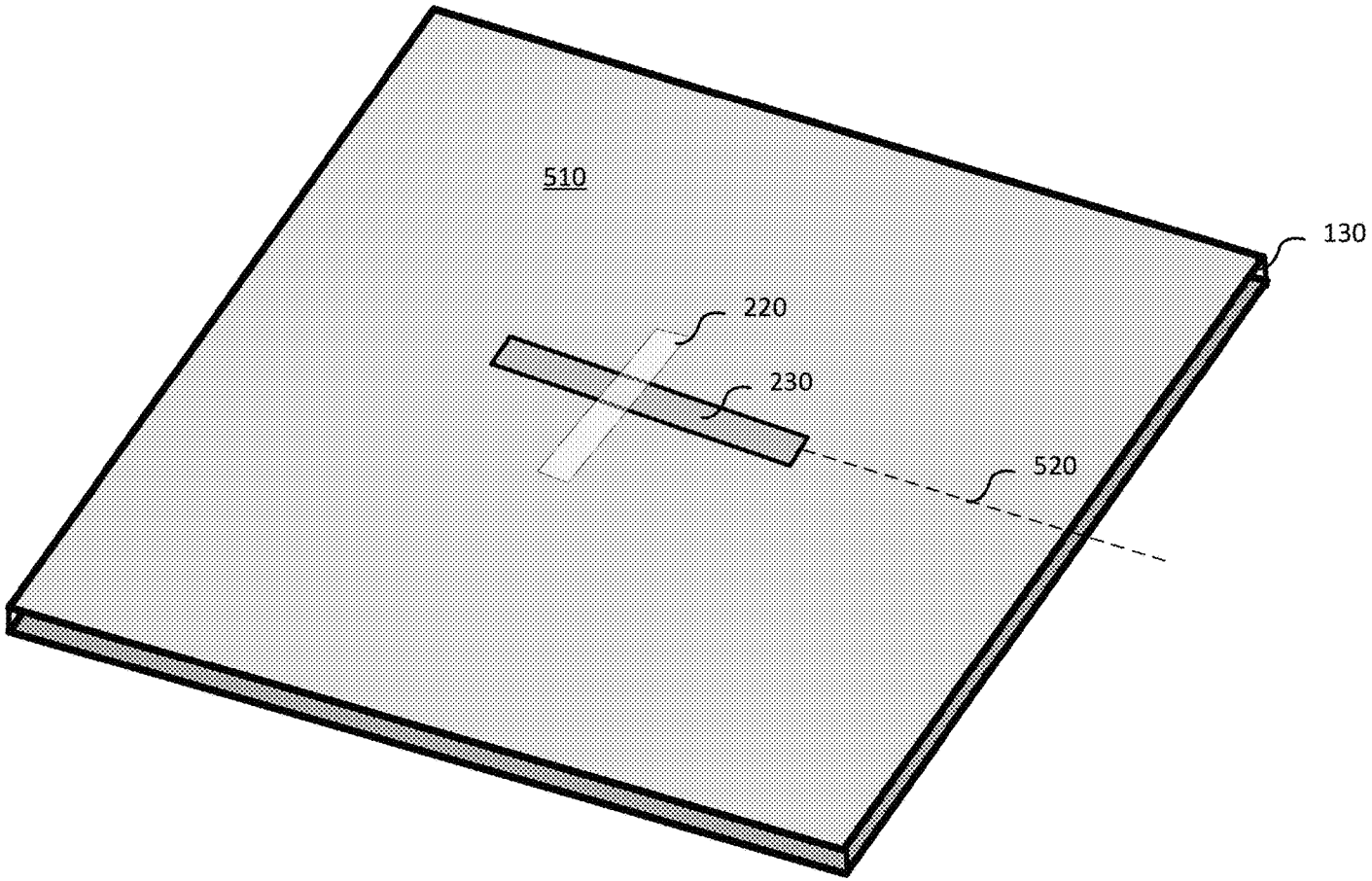
FIG. 5 shows a perspective view of the printed circuit board substrate of the DRA.

As shown in FIG. 5, the feeding substrate 130 is provided by a printed circuit board (PCB) with a ground plane 510. The ground plane has slot 220 providing an opening with the ground plane which aligns with the first antenna region 110 on the top surface 210. The slot 220 is defined by a rectangular opening in the ground plane 510 material. In an embodiment the slot may be approximately 0.36 mm in width and 1.35 mm in length. The microstrip feeding line 230 is provided on the bottom surface 212 and aligns with the slot 220 underneath the feeding substrate 130. In an embodiment the microstrip feeding line 230 extends approximately 0.82 mm beyond the width of the slot 220. The microstrip feeding line 230 connects to a microstrip feed network 520.

Figure 6:
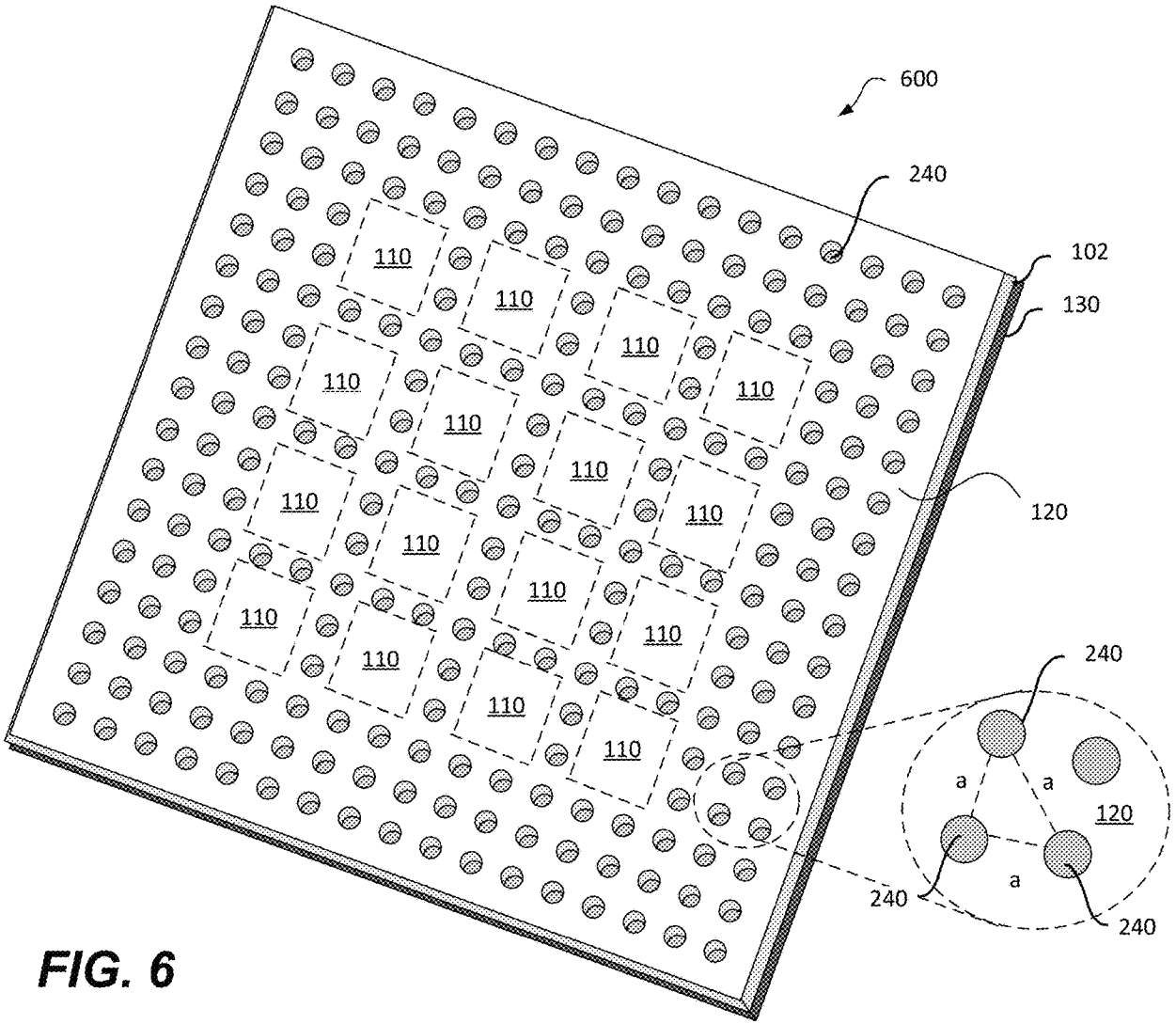
FIG. 6 shows a perspective view of the DRA array.

FIG. 6 shows a perspective view of a DRA array 600. The antenna array comprises multiple first antenna regions 110 defined with the dielectrics 102 that are surrounded by second antenna region 120 defined by the creation of air holes 240 within the monolithic dielectric 102. In the embodiment shown the first antenna regions are arranged in the four by four grid with the second antenna region 120 positioned between and around the first antenna regions 110. The air holes 240 are provided to synthesize the dielectric material between the antenna elements in the second antenna region 120. The air holes 240 can be disposed in a rectangular arrangement but may also be arranged in a non-rectangular arrangement, such as triangular lattice or circular lattice, as long as the periodicity is small compared to the wavelength. When this condition is achieved the dielectric with the air holes behaves as an homogeneous dielectric without air holes and with smaller value of the dielectric constant. In terms of wavelength spacing, the antenna elements are $\lambda/2$ at the high frequency band and $\lambda/4$ at the lower frequency band. The air holes 240 can be positioned equidistant from each other, where for air holes 240 of diameter D the equivalent dielectric constant and loss tangent are given by:

$$\varepsilon_{avg} = \frac{\pi}{2\sqrt{3}}\left(\frac{D}{a}\right)^2 + \varepsilon_r\left(1 - \frac{\pi}{2\sqrt{3}}\left(\frac{D}{a}\right)^2\right)$$

$$\tan\delta_{avg} = \tan\delta\left(1 - \frac{\pi}{2\sqrt{3}}\left(\frac{D}{a}\right)^2\right)$$

where $\alpha$ is the distance between air holes 240. In an embodiment the first antenna region can be positioned approximately 3 mm from respective sensors with air holes of approximately 0.3 mm radius with approximately 1 mm space between air hole centers. Although circular air holes are shown, other shapes or combination of shapes may define the air holes in the second antenna region. The dimensions of the antenna element can be modified depending on the operating frequencies, dielectric properties, and the shapes of the antenna regions. Distance between elements are given after in terms of wavelengths. Other patterns for the air holes can be used and it is still possible to evaluate the equivalent dielectric constant. Different technology can be used to manufacture the modification made on the dielectric (air holes or other shapes).

Figure 7:
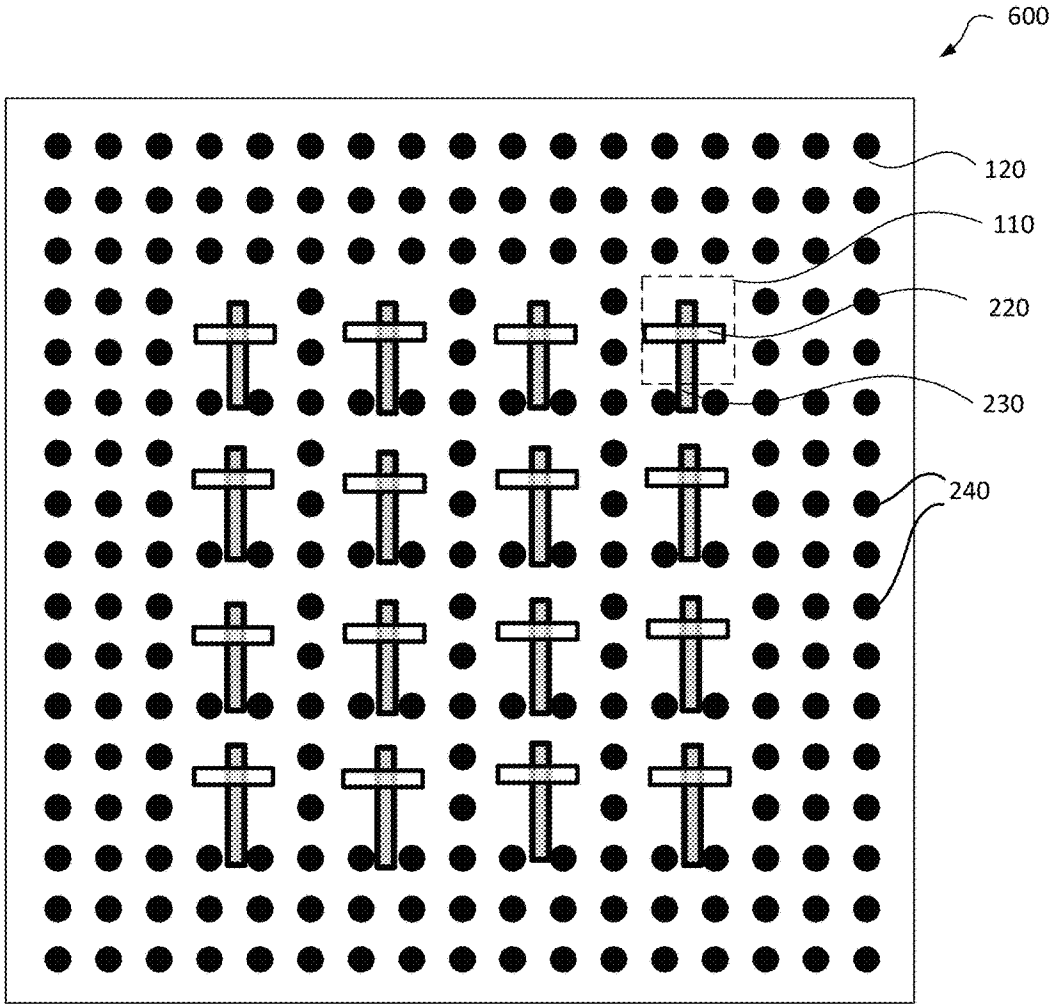
FIG. 7 shows a top view of the DRA array.

As shown in FIG. 7, in a top view of the DRA array 600 showing a representation of the positioning of the slots 220 within each first antenna region 110 and the microstrip feed line 230 extends into the second portion 120. In this example a rectangular DRA is shown. The microstrip feed lines 230 are connected by a feed line network on the bottom of the feeding substrate 130. A single feed network can be used having a compact microstrip power divider having branches to each of the antenna elements.

Figure 8:
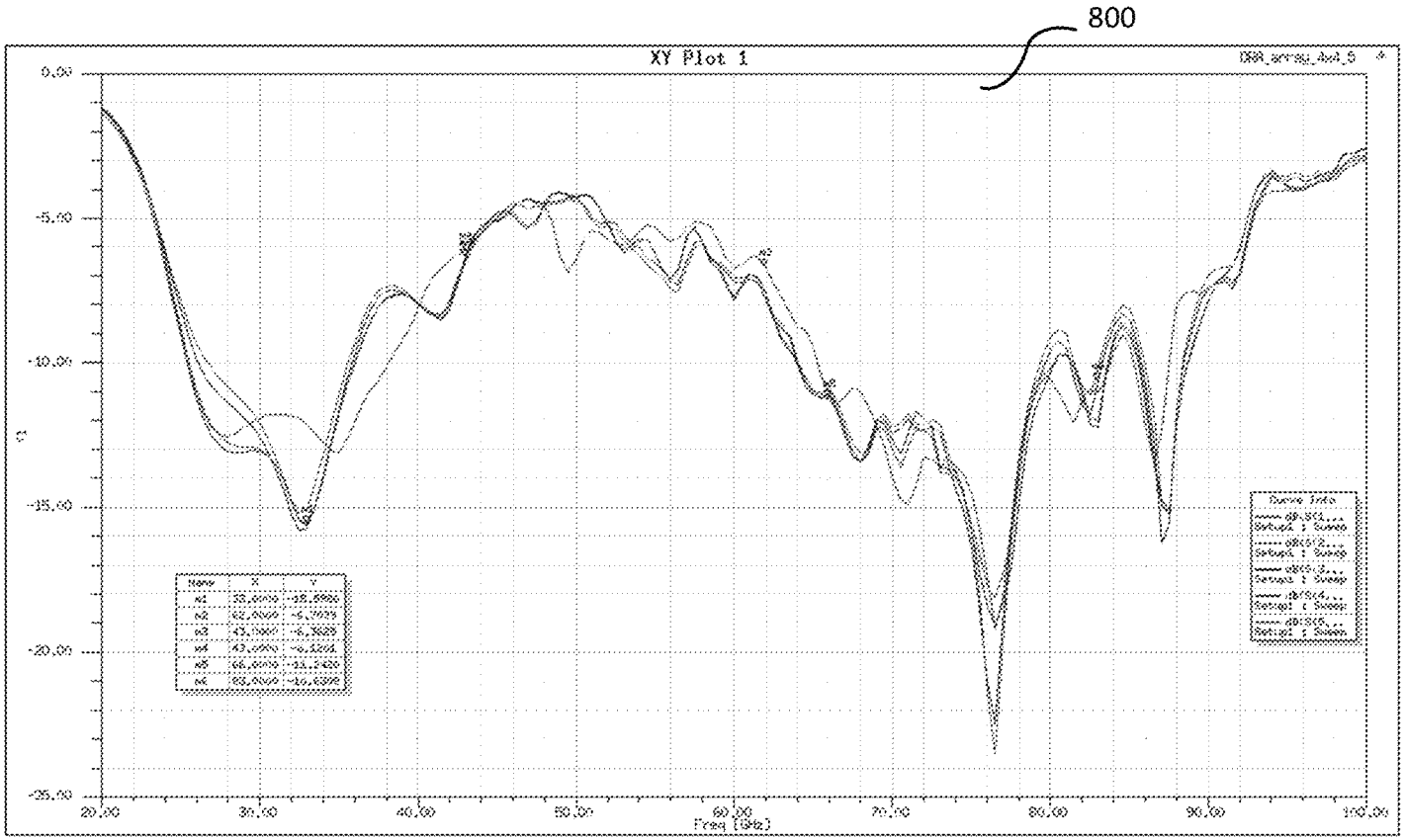
FIG. 8 shows a graph of return loss versus frequency of the DRA array according to an embodiment of the present disclosure.

FIG. 8 shows a graph of return loss versus frequency of an artificial rectangular dielectric resonator antenna (DRA) antenna array. The DRA design having the dimensions described in reference to FIG. 6 was excited at two modes TE111 and TE113 producing the plot 800. Full-wave numerical results of the antenna array show that the antenna elements are well matched with a return loss lower than −10 dB (S11<−10 dB) at the two operating frequency bands (30 GHz and 60 GHz).

Figure 9:
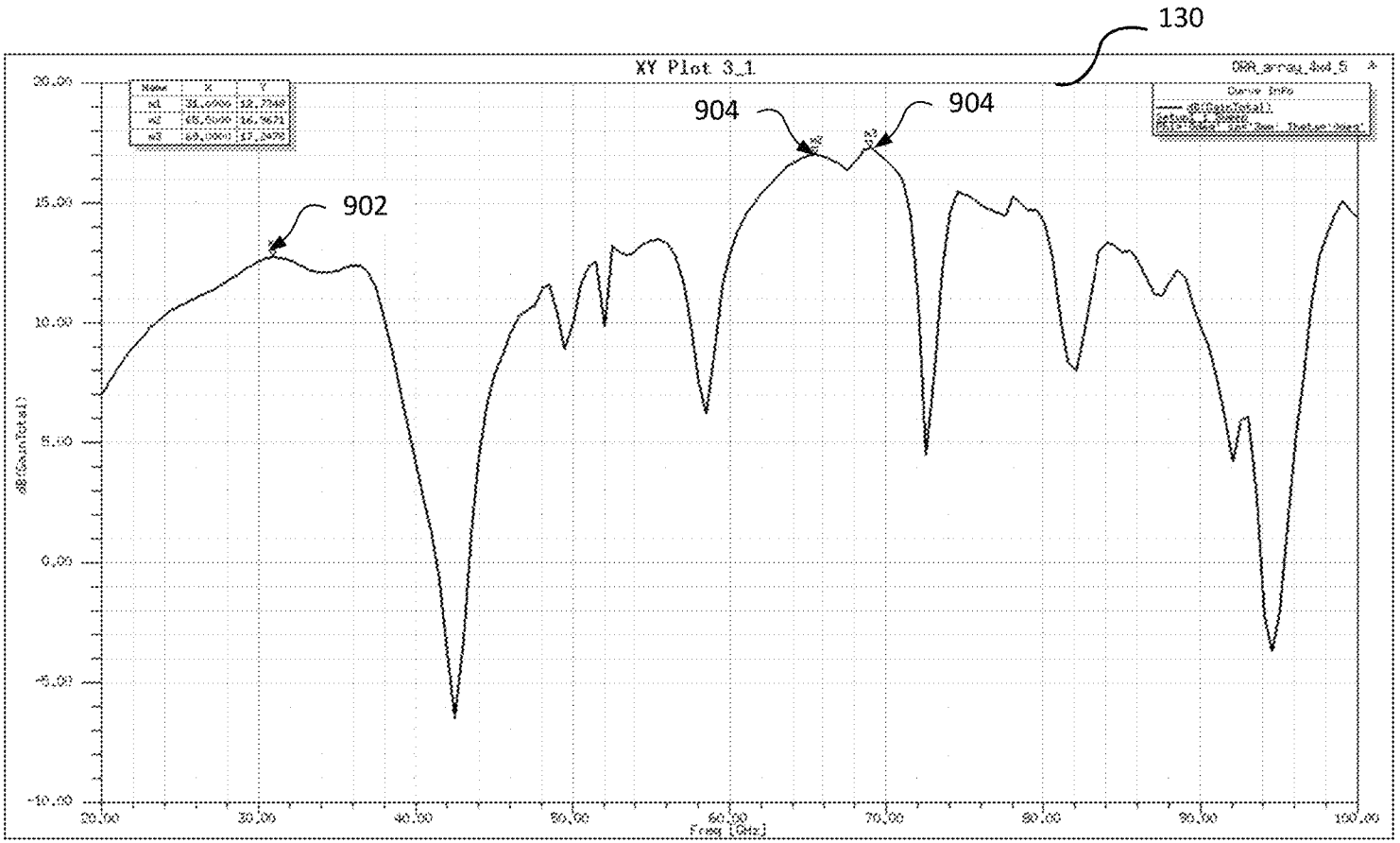
FIG. 9 shows a graph of gain variation versus frequency of the DRA array of an embodiment of the present disclosure.

FIG. 9 shows a graph of gain variation versus frequency of an artificial rectangular dielectric resonator antenna (DRA) antenna array. Three gain points at 31 GHz 902, 65 GHz 904 and 69 GHz 906 are shown. The DRA array configuration provides the same area for the high and low frequency but provides more gain at the higher frequencies.

Figure 10:
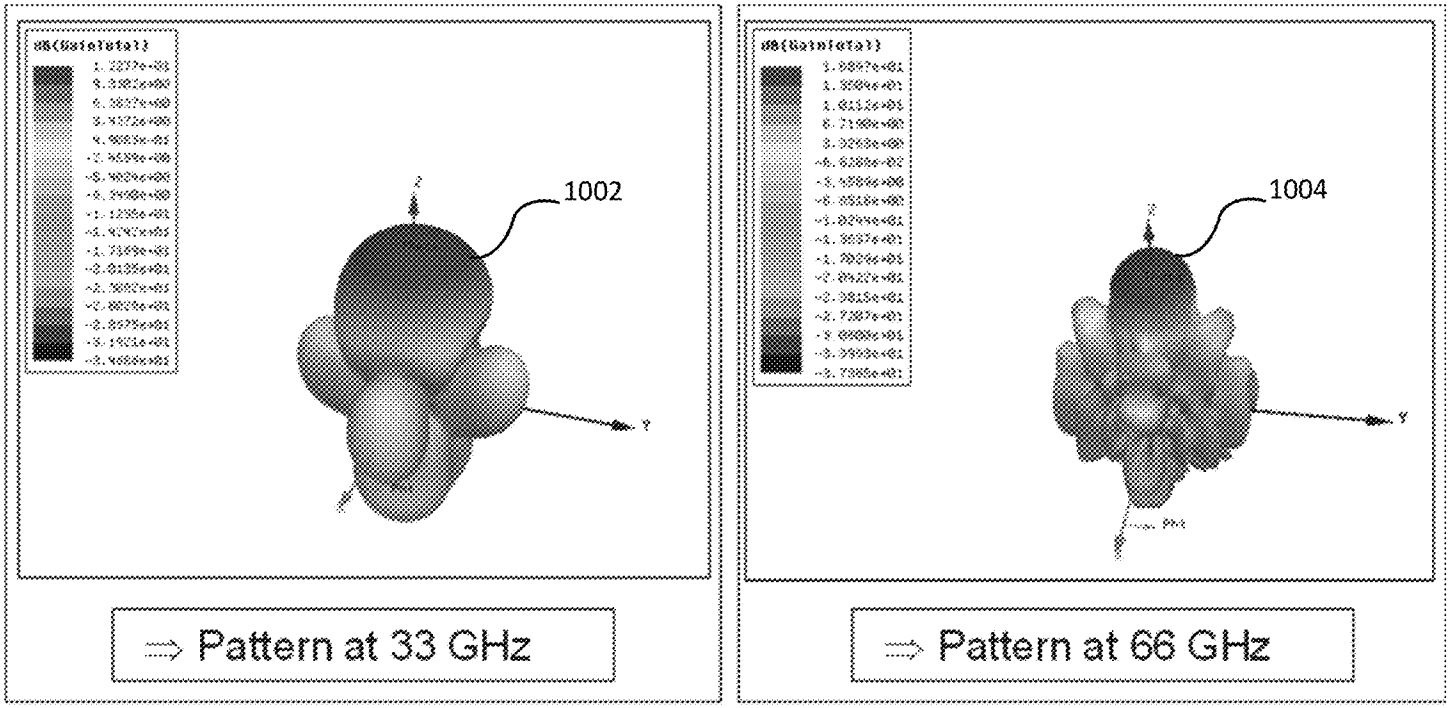
FIG. 10 shows patterns for DRA array at 33 GHz and 66 GHz of an embodiment of the present disclosure.

FIG. 10 shows patterns for DRA array at 33 GHz and 66 GHz in accordance with an embodiment of the present disclosure as shown in FIG. 6. At the higher frequency such as 66 GHz the DRA design can provide more gain for the main lobe 1004, for example +16.89 dB compared to at the lower frequency, such as 33 GHz, the main lobe 1004, where a gain is achieved, for example of +12.27 dB.

It would be appreciated by one of ordinary skill in the art that the system and components shown in FIGS. 1-10 may include components not shown in the drawings. For simplicity and clarity of the illustration, elements in the figures are not necessarily to scale, are only schematic and are non-limiting of the elements structures. It will be apparent to persons skilled in the art that a number of variations and modifications to the described arrangement, dimensions or orientations can be made without departing from the scope of the invention as defined in the claims.

The present disclosure provided, for the purposes of explanation, numerous specific embodiments, implementations, examples and details in order to provide a thorough understanding of the invention. It is apparent, however, that the embodiments may be practiced without all of the specific details or with an equivalent arrangement. In other instances, some well-known structures and devices are shown in block diagram form, or omitted, in order to avoid unnecessarily obscuring the embodiments of the invention. The description should in no way be limited to the illustrative implementations, drawings, and techniques illustrated, including the exemplary designs and implementations illustrated and described herein, but may be modified within the scope of the appended claims along with their full scope of equivalents.

While several embodiments have been provided in the present disclosure, it should be understood that the disclosed systems and components might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

The invention claimed is:

1. A multi-band single feed dielectric resonator antenna (DRA) comprising:

a single layer of monolithic dielectric material forming:

a radiating first antenna region of the dielectric material, wherein the first antenna region has a first dielectric constant; and a non-radiating second antenna region of the dielectric material, wherein the dielectric material of the second antenna region is provided with a plurality of spaced apart physical modifications that cause the second antenna region to have a second dielectric constant that is different from the first dielectric constant, the second antenna region surrounding a perimeter of the first antenna region;

a feeding substrate supporting the dielectric material, the feeding substrate comprising:

a top surface ground plane having a slot positioned below the first antenna region of the dielectric material; and a microstrip feeding line on a bottom surface, the microstrip feeding line having a first portion positioned below the first antenna region in alignment with the slot on the top surface ground plane, and a second portion that extends from the first portion along the bottom surface to a location below the second antenna region in alignment with a space between at least a pair of the plurality of physical modifications of the dielectric material of the second antenna region.

2. The DRA of claim 1 wherein the first dielectric constant is greater than the second dielectric constant.

3. The DRA of claim 2 wherein the first antenna region and second antenna region are contiguous within the dielectric material.

4. The DRA of claim 1, wherein the monolithic dielectric material forming the second antenna region and the first antenna region has the same dielectric constant throughout the second antenna region and the first antenna region.

5. The DRA of claim 4 wherein the physical modifications of the second antenna region include at least one of: voids, air holes, perforations, or indentations in or through the second antenna region.

6. The DRA of claim 5 wherein the physical modifications include a plurality of air holes through the second antenna region that have a radius of approximately 0.3 mm.

7. The DRA of claim 5 wherein the physical modifications include a plurality of air holes through the second antenna region and the second dielectric constant is determined by a spacing between the air holes and diameters of the air holes.

8. The DRA of claim 1 wherein the second antenna region modifies radiating modes of the first antenna region.

9. The DRA of claim 1 wherein the slot and the microstrip feeding line are rectangular.

10. The DRA of claim 9 wherein the slot and the microstrip feeding line are perpendicular to each other.

11. A dielectric resonator antenna (DRA) array comprising:

a single layer of monolithic dielectric material forming:

a plurality of radiating first antenna regions each having a first dielectric constant; and a plurality of non-radiating second antenna regions of the dielectric material, wherein the dielectric material of each second antenna region is provided with a respective plurality of spaced apart physical modifications that cause the second antenna region to have a second dielectric constant that is different from the first dielectric constant, each second antenna region surrounding a perimeter of a respective first antenna region;

a feeding substrate supporting the dielectric material, the feeding substrate comprising:

a top surface ground plane having a plurality of slots, each slot positioned below the respective first antenna region of the dielectric material; and a plurality of microstrip feeding lines on a bottom surface, each mircostrip feeding line having a first portion positioned below the respective first antenna region in alignment with the respective slot on the top surface ground plane, and a second portion that extends from the first portion along the bottom surface to a location below the respective second antenna region in alignment with a respective space between at least a pair of the respective plurality of physical modifications of the dielectric material of the second antenna region.

12. The DRA array of claim 11 wherein the second dielectric constant of the second antenna region is determined by a plurality of at least one of: voids, air holes, perforations, or indentations in or through the second antenna region.

13. The DRA array of claim 11 wherein the second dielectric constant of the second antenna region is determined by a plurality air holes through the second antenna region that each have a radius of approximately 0.3 mm.

14. The DRA array of claim 11 wherein the second dielectric constant is determined by a spacing between a plurality of air holes through the second dielectric region and diameters of the plurality of air holes.

15. The DRA array of claim 11 further comprising a feed array to each of the microstrip feeding lines wherein the feed array receives a multi-band signal.

16. The DRA array of claim 11 wherein the first dielectric constant is greater than the second dielectric constant.

17. The DRA array of claim 11 wherein the second antenna region modifies radiating modes of the first antenna region.

18. The DRA array of claim 11 wherein the slots and the microstrip feeding lines are rectangular.

19. The DRA array of claim 18 wherein the slots and the microstrip feeding lines are perpendicular to each other.

20. The DRA array of claim 11 wherein the substrate is a printed circuit board (PCB).

21. The DRA array of claim 11 wherein each of the plurality of first antenna regions are arranged in a contiguous grid pattern within the second antenna region.

* * * * *